United States Patent [19]

Brosius

[11] Patent Number: 5,011,118

[45] Date of Patent: Apr. 30, 1991

[54] JACK

[75] Inventor: Peter Brosius, Ayl, Fed. Rep. of Germany

[73] Assignee: August Bilstein GmbH & Co. KG, Ennepetal, Fed. Rep. of Germany

[21] Appl. No.: 546,107

[22] Filed: Jun. 29, 1990

[30] Foreign Application Priority Data

Jul. 3, 1989 [DE] Fed. Rep. of Germany ..... 3921826

[51] Int. Cl.[5] ..... B66F 3/12

[52] U.S. Cl. ..... 254/126; 254/DIG. 4

[58] Field of Search ..... 248/99; 254/126, 8 B, 254/133, 134, 101, DIG. 4; 16/387; 29/11

[56] References Cited

U.S. PATENT DOCUMENTS

| | | | |
|---|---|---|---|
| 3,991,961 | 11/1976 | Platzer | 248/291 |
| 4,194,725 | 3/1980 | Erschens | 254/126 |
| 4,919,392 | 4/1990 | Minuto | 254/126 |

*Primary Examiner*—Robert C. Watson

*Attorney, Agent, or Firm*—Max Fogiel

[57] ABSTRACT

The invention concerns a jack (10) with at least one leg (12) and an arm (16) that is connected to it, that can move up and down with its position varied by an adjusting mechanism (26), and that has a supporting plate (40) at its outer and free end that pivots on a horizontal shaft (52) on the arm. The supporting plate is secured to the shaft by at least one eye (50) that is stamped out of the supporting-plate component, whereby the ends of the eyes are in one piece with components of the supporting plate.

7 Claims, 2 Drawing Sheets

JACK

BACKGROUND OF THE INVENTION

The invention concerns a jack with at least one leg and with an arm articulated thereto that can be raised and lowered, that can be variously positioned by a setting mechanism, and that has a supporting plate at its outer and free end articulated to the arm at a more or less horizontal shaft.

A jack of this type is known (German Patent No. 2 801 735). It has a rotational shaft that accommodates a supporting plate at its outer and free end. The shaft that accommodates the plate, however, is rigidly secured to the arm, and lateral forces could occur while a vehicle is being lifted by the jack that would buckle the jack or its supporting components. Lateral forces of this type occur in particular when the jack is being operated on a hill and must be positioned at an angle to the vehicle. In such cases the supporting plate can be subjected to load on only one side and can be damaged, especially at the flanges that connect the plate to an associated bolt secured to the arm. If the load is very heavy on one side, the flanges around the bolt or the shaft can get bent.

SUMMARY OF THE INVENTION

The object of the present invention accordingly is to improve the design and position of the supporting plate articulated to the arm so that the plate and the articulation between the plate and the arm will not be damaged even when only one side of the plate is subjected to load. The advantageous design of the eyes stamped out of the supporting-plate component and remaining in one piece with the supporting plate at the end results in a more reliable accommodation for the shaft, so that, even when only one side of the plate is subjected to load, especially when the jack is being used on a hill, the shaft will not be forced out of the eyes, which can no longer be bent out. This is attained in particular in that the ends of the eyes remain in one piece with the components of the plated even after the stamping out, ensuring a permanent connection between the ends of the eyes and the supporting plate.

The advantageous design of the eyes that accommodate the shaft makes it possible to also preliminarily mount the supporting plate and shaft in the form of a subassembly that is then rigidly secured to the arm, for which purpose the shaft can be but welded to the sides of the arm.

The advantage of another embodiment of the invention is that the eyes, which are separated, come to rest against the parallel sides of the arm once the supporting plate has been mounted on it, preventing lateral displacement of the plate. It is also of advantage for the shaft as an alternative to have undulating depressions to accommodate the eyes and prevent the plate from sliding along the shaft. It is also of advantage for the eyes to be on the bottom of the supporting plate, ensuring that the plate will have a flat contact surface.

BRIEF DESCRIPTION OF THE DRAWINGS

One embodiment of the invention will now be described in greater detail with reference to the drawing, wherein.

DESCRIPTION OF THE PREFERRED EMBODIMENTS

Figure 1:
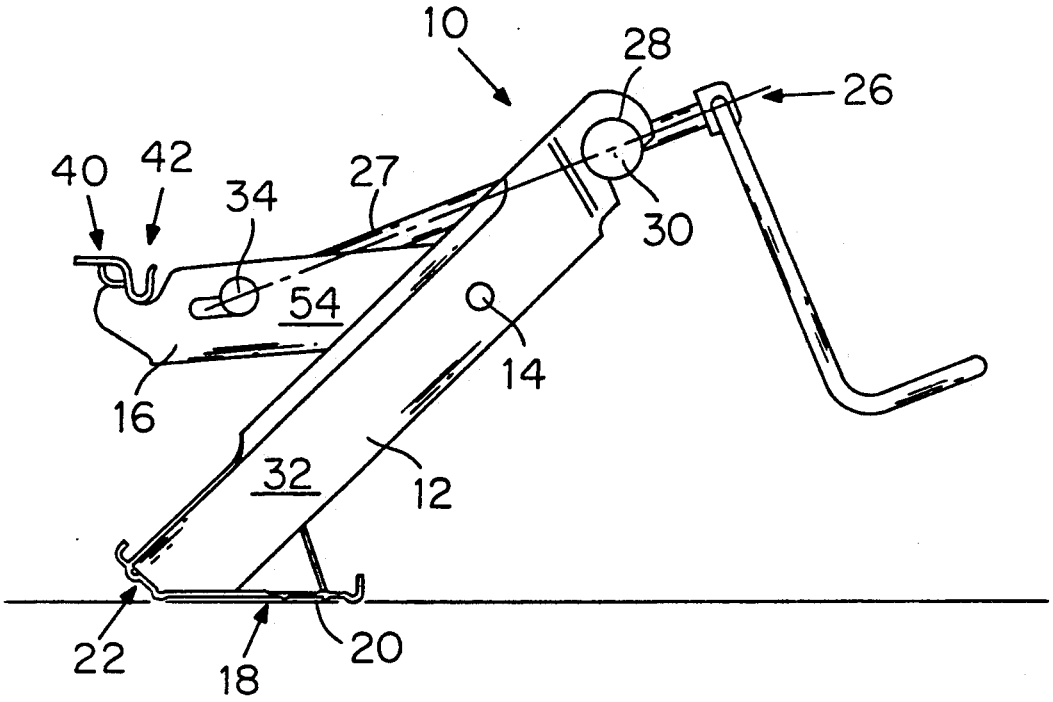
FIG. 1 is a schematic representation of a jack with a supporting plate articulated to an arm and FIG. 2 is a perspective representation of the front end of the supporting plate and arm as viewed from below.

A jack 10 consists of a leg 12 and of an arm 16 that pivots vertically on it on a bolt 14. At the bottom end of leg 12 is a base plate 18 with a rollover foot 20. Base plate 18 settles jack 10 against the ground when it is applied to a motor vehicle. Also mounted on foot 20 at an angle to base plate 18 is a toe plate 22.

At the top of leg 12, which can be U-shaped for example, is an adjusting mechanism 26 in the form of a threaded spindle 27 that pivots on a nut 28. Nut 28 has pins 30 on each side that secure it in the sides 32 of leg 12.

Arm 16 is articulated to the bottom of spindle 27 by an unillustrated bearing, a roller bearing for example, one race of which is in contact with the spindle and the other race of which has pins 34 that engage the sides 54 of U-shaped arm 16.

As will be evident from FIG. 1, arm 16 is articulated to leg 12 by way of bolt 14 and pivots in relation to it in accordance with the position of adjusting mechanism 26. At the free end of arm 16 is a supporting plate 40, through which jack 10 is applied to the bottom of a motor vehicle. Supporting plate 40 has a depression 42 for accommodating the sill seam on the bottom of an unillustrated vehicle. Extending out of depression 42 is an abutting area 44 that rests against the bottom of a vehicle and keeps the sill seam away from supporting plate 40. The abutting area is as extensive as possible to reduce the pressure on the bottom of the vehicle.

Figure 2:
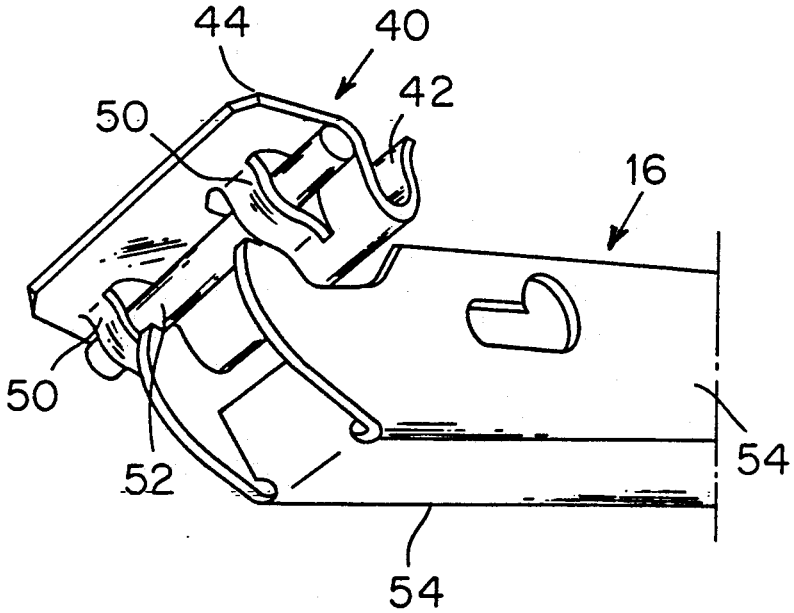
Figure 3:
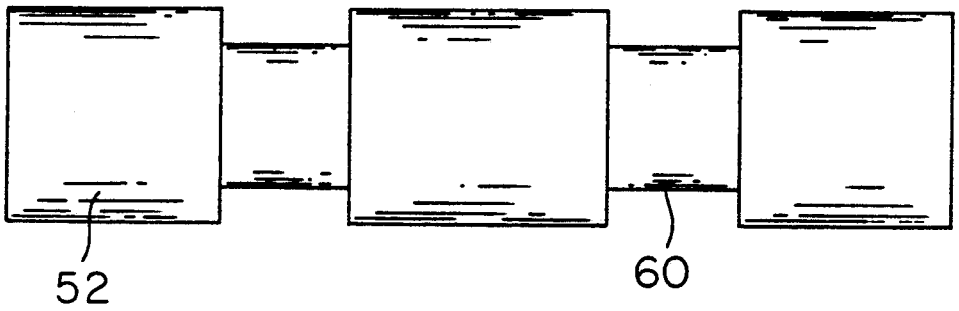

As will be especially evident from FIG. 2, two separated eyes 50 are stamped out of the abutting area 44 of supporting plate 40 with their ends in one piece with components of the plate. Eyes 50 are on the bottom of abutting area 44 and accommodate a shaft or bolt 52. Supporting plate 40 and shaft 52 can be in the form of a preliminarily assembled subassembly that can easily be applied to the front of arm 16. A secure connection between supporting plate 40 and the front of arm 16 can be attained by butt-welding shaft 52 to the sides 54 of the arm. The distance between the inner areas of eyes 50 is somewhat longer than the distance between the outer areas of sides 54, and, when supporting plate 40 is connected to the front of arm 16, the inner areas of eyes 50 will come to rest against the outer areas of sides 54, preventing supporting plate 40 from sliding along bolt or shaft 52. Supporting plate 40 can also be axially secured by undulating depressions 60 in the bolt for eyes 50 to engage. For this purpose shaft 52 is introduced into eyes 50, which are forced together until they engage the undulations.

I claim:

1. A jack comprising: at least one leg; an arm pivotably connected to said leg; height adjusting means supported by said leg and connected to said arm for raising and lowering said arm; said arm having an outer free end; a supporting plate on said outer free end of said arm; a horizontal shaft on said outer free end, said supporting plate pivoting on said horizontal shaft; said supporting plate having at least one eye for securing said supporting plate to said shaft, said eye being stamped out of said supporting plate; said eye having ends integral and in one piece with said supporting plate, said plate supporting a load stably and safely in every angular position of said plate that said plate may assume when supporting said load without damaging said plate even when said plate is loaded only on one side of said plate.

2. A jack as defined in claim 1, wherein said supporting plate and said shaft comprise a pre-assembled subassembly, said shaft being weldable to said arm.

3. A jack as defined in claim 1, wherein at least two separate eyes are spaced from each other and rest against parallel sides of said arm.

4. A jack as defined in claim 3, wherein said shaft has undulating depressions accommodating said eyes.

5. A jack as defined in claim 3, wherein said eyes are located on a bottom of said supporting plate.

6. A jack for a vehicle comprising: at least one leg; an arm pivotably connected to said leg; height adjusting means supported by said leg and connected to said arm for raising and lowering said arm; said arm having an outer free end; a supporting plate on said outer free end of said arm; a horizontal shaft on said outer free end, said supporting plate pivoting on said horizontal shaft; said supporting plate having at least one eye for securing said supporting plate to said shaft, said eye being stamped out of said supporting plate; said eye having ends integral and in one piece with said supporting plate, said supporting plate supporting a vehicle stably and safely in every angular position of said plate that said plate may assume when supporting said vehicle without damaging said plate even when said plate is loaded only on one side of said plate by said vehicle.

7. A jack for a vehicle comprising: at least one leg; an arm pivotably connected to said leg; height adjusting means supported by said leg and connected to said arm for raising and lowering said arm; said arm having an outer free end; a supporting plate on said outer free end of said arm; a horizontal shaft on said outer free end, said supporting plate pivoting on said horizontal shaft; said supporting plate having at least one eye for securing said supporting plate to said shaft, said eye being stamped out of said supporting plate; said eye having ends integral and in one piece with said supporting plate, said supporting plate supporting a vehicle stably and safely in every angular position of said plate that said plate may assume when supporting said vehicle without damaging said plate even when said plate is loaded only on one side of said plate by said vehicle; said supporting plate and said shaft comprising a pre-assembled subassembly, said shaft being weldable to said arm; at least two separated eyes resting against parallel sides of said arm; said shaft having undulating depressions accommodating said eyes; said eyes being on a bottom of said supporting plate.

* * * * *